United States Patent [19]

Darlington

[11] Patent Number: 4,756,296

[45] Date of Patent: Jul. 12, 1988

[54] HIGH ENERGY COMPOUND BOW

[76] Inventor: Rex F. Darlington, 3540 Darton Rd., Hale, Mich. 48739

[21] Appl. No.: 11,692

[22] Filed: Feb. 6, 1987

Related U.S. Application Data

[63] Continuation-in-part of Ser. No. 728,495, Apr. 29, 1985, abandoned.

[51] Int. Cl.[4] ..... F41B 5/00

[52] U.S. Cl. ..... 124/24 R; 124/23 R; 124/DIG. 1

[58] Field of Search ..... 124/23 R, 24 R, DIG. 1

[56] References Cited

U.S. PATENT DOCUMENTS

| | | | |
|---|---|---|---|
| 3,486,495 | 12/1969 | Allen | 124/DIG. 1 |
| 4,338,910 | 7/1982 | Darlington | 124/24 R |
| 4,340,025 | 7/1982 | Caldwell | 124/86 |
| 4,515,142 | 5/1985 | Nurney | 124/DIG. 1 |
| 4,686,955 | 8/1987 | Larson | 124/DIG. 1 |

OTHER PUBLICATIONS

Bow and Arrow, Oct. 1985, p. 4.

*Primary Examiner*—Randolph A. Reese
*Assistant Examiner*—Anthony Knight
*Attorney, Agent, or Firm*—Barnes, Kisselle, Raisch, Choate, Whittemore & Hulbert

[57] ABSTRACT

A high energy compound bow having multiple pulley sheaves eccentrically mounted on a common axis at each bifurcate distal end of the respective bow limbs. The bowstring is extended at each end over the pulley sheaves to a return cable, the ends of which are looped over anchor sheaves at the respective axles. The anchor sheaves are clustered centrally of the space between the bifurcate sections of the bow limbs with the bowstring pulley and a transition pulley which is positioned between the bowstring pulley and the anchor sheave. The transition sheave has a curved path which originates laterally of the bow limb essentially at the lateral position of the anchor sheave in the at-rest position of the bowstring. This sheave path shifts laterally as the bow is drawn to a position central to the bowstring pulley and the anchor sheave thereby centralizing the tension stress on the bow limbs to eliminate torque on the limbs at the high tension phase of the draw and release. The composite pulley may be formed of two molded parts to permit varying draw lengths to be utilized on a particular bow. The secondary pulley section is formed with a minimal lateral dimension and radial clearance at the axle to provide space for location of an anchor sheave close to the center of the axle without interference during rotation. The secondary pulley then sweeps laterally outward to provide the secondary pulley sheaves spaced from the primary pulley. Outer cam surfaces on the pulley sheaves insure positive tracking of the return cables as they move toward the center.

2 Claims, 3 Drawing Sheets

RIGHT SIDE

LEFT SIDE

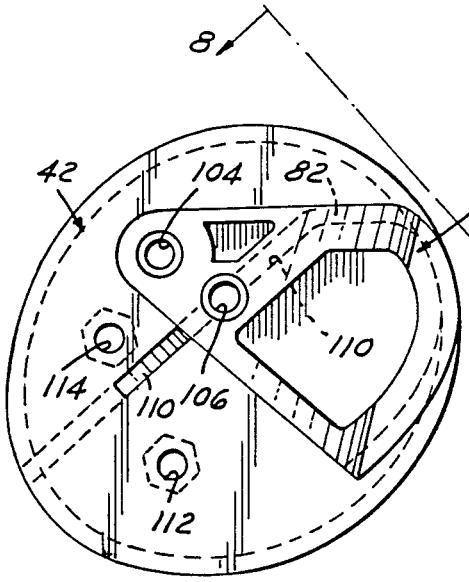
FIG.7
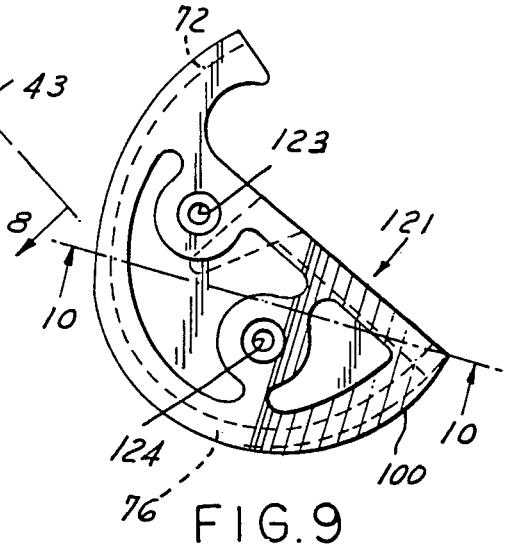
FIG.9
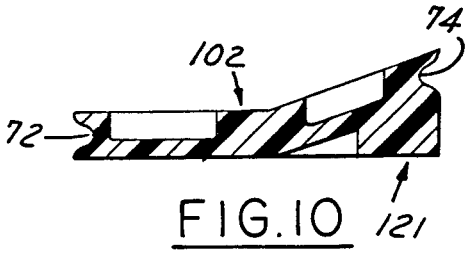
FIG.10
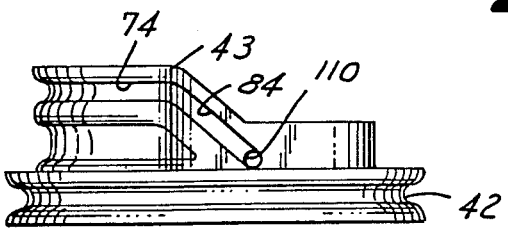
FIG.8
FIG.6
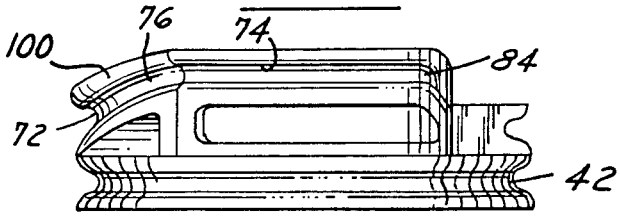

HIGH ENERGY COMPOUND BOW

REFERENCE TO RELATED APPLICATION

This application is a continuation-in-part of my copending application, Ser. No. 728,495, filed Apr. 29, 1985, now abandoned.

FIELD OF INVENTION

Compound archery bows with variable leverage wheels which decrease necessary pull on fully drawn bowstrings.

BACKGROUND AND OBJECTIVES OF THE INVENTION

The goals of a properly designed compound bow include the use of an eccentric wheel as disclosed in the U.S. Pat. No. 3,486,495, to Allen, issued Dec. 30, 1969. With this type of bow, eccentrically mounted wheels are positioned at the ends of the bow limb. During the draw by the archer, the wheels move over center to decrease the holding force at full draw while storing the required energy for the propulsion of the released arrow. Allen disclosed round wheels but recent developments have utilized what is referred to as high energy wheels with contours which store greater energy during the draw and gain in shooting performance. Reference is made also to a U.S. Pat. No. 4,340,925, to Caldwell, issued July 20, 1982.

Another goal in the design of bows which utilize high performance wheels is the elimination of the need for cable guards for the purpose of cable clearance for arrows and fletching during the release phase.

A further goal is the elimination of the torquing or twisting of the bow limb as they are being flexed during the draw and the release.

Because of the additional energy being stored with the use of the high performance bow limb wheels as the bow is drawn and because of the amount of tension being transferred from the string cable to the anchor cable, it is not possible to achieve the above outlined goals with the present state of the art bows as exemplified in the Allen patent above identified or in the U.S. Pat. No. 4,338,910, to Darlington, issued July 13, 1982.

It is therefore an object of the present invention to provide a high energy bow design which achieves as nearly as possible the goals set forth above. These goals are achieved as briefly set forth below.

First, the anchor end of the anchor cables are located as far as possible toward the center of the bow limb in relation to outermost secondary pulley groove as distinguished from the main drawstring pulley as will be explained in the detailed description.

Second, as is known in bow design, the arrow and fletching clearance is maintained by positioning the secondary pulley groove offset from the true center of the bow through the initial portion of the draw. This also offsets or balances the initial tension of the drawstring which is far greater at that phase of the draw.

Third, form the groove in the secondary pulley so that it moves transversely across the pulley as it is rotated in the draw so the groove is as close as possible to the groove in the primary pulley as the bow is drawn to its peak load.

Fourth, through the remainder of the draw, the cable tension will be as close to the center line of the bow limbs as possible.

An additional object is the provision of a camming sheave groove to insure transition of a cable sheave during the draw.

A further object and feature is the design of the pulley to provide axial and radial clearance on the composite pulley so the cable end anchor point can be as near as possible to the center of each bow limb to concentrate the forces at the center of the limb.

Other objects and features of the invention will be evident in the following description and claims in which the invention is described together with details to enable persons skilled in the art to practice the invention, all in connection with the best mode presently contemplated for the invention.

BRIEF DESCRIPTION OF THE DRAWINGS

Drawings accompany the disclosure and the various views thereof may be briefly described as:

FIG. 6, an elevation of a portion of the eccentric pulley taken on line 6—6 of FIG. 4 showing the lateral transition path of the sheave.

FIG. 7, an elevation of the primary pulley with a segment of the transition pulley.

FIG. 8, a view on line 8—8 of FIG. 7.

FIG. 9, an elevation of a completion segment of the transition pulley.

FIG. 10, a sectional view on line 10—10 of FIG. 9.

DETAILED DESCRIPTION OF THE INVENTION AND THE MANNER AND PROCESS OF USING IT

Figure 1:
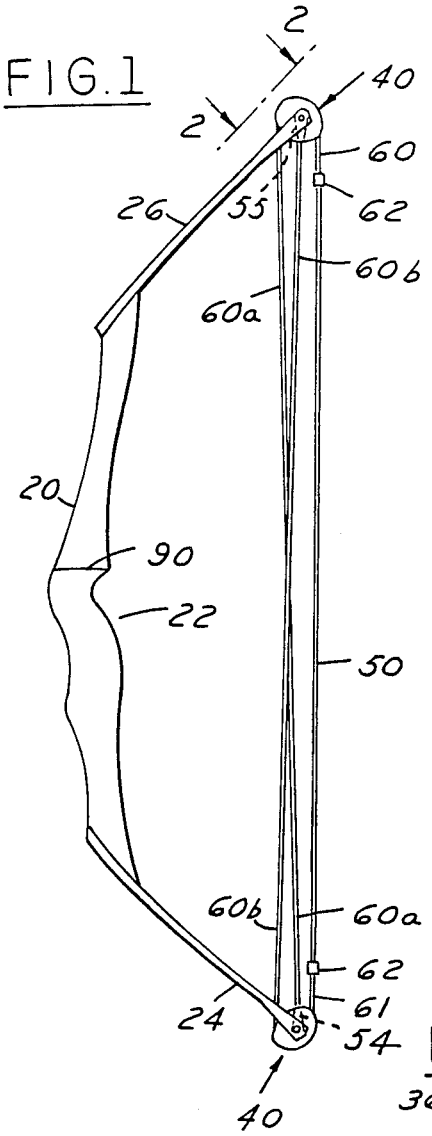
FIG. 1, a side elevation of a compound bow in which the invention is incorporated.

With reference to the drawings, a bow handle 20 has a grip section 22 and bow limbs 24 and 26 attached at the proximal end in the usual fashion and extending from the respective ends of the handle section.

Each distal end of each bow limb is bifurcate with spaced parallel extensions 30 and 32 (FIG. 2) transfixed by an axle shaft 34 grooved at each end to receive split retainer washers 36.

Figure 3:
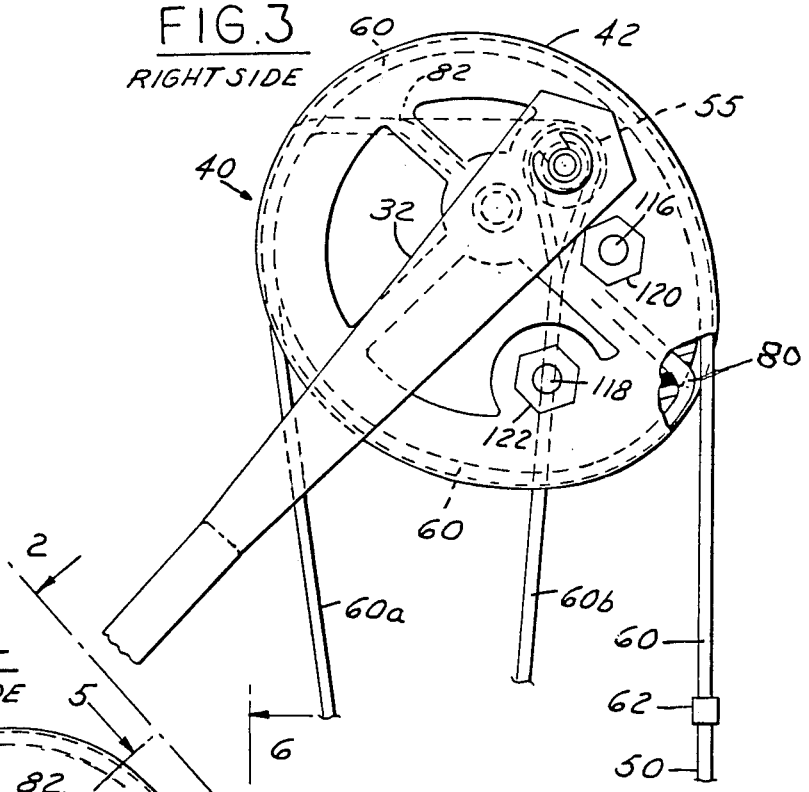
FIG. 3, an enlarged elevation of a bow limb assembly from the right side as viewed in FIG. 2.
Figure 4:
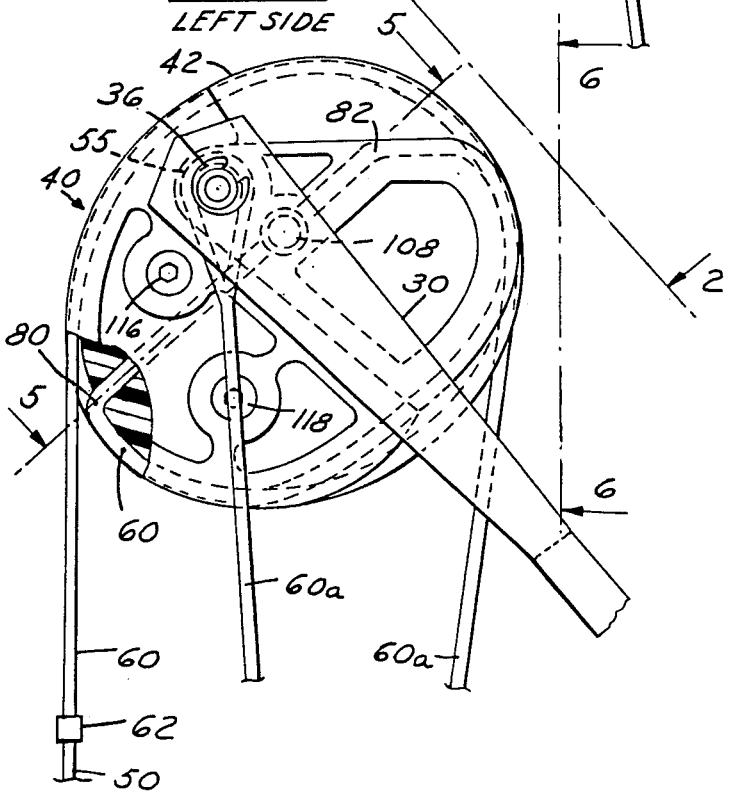
FIG. 4, an enlarged elevation of a bow limb assembly from the left side as viewed in FIG. 2.

A high energy pulley assembly 40 is mounted on the axle shafts 34 at the distal end of each bow limb to carry the bowstring and return cables of the compound bow. The pulley assembly is composed of a primary pulley section or base cam 42 eccentrically mounted on the axle shaft 34 and having a full pulley groove around its periphery to carry the cable extension of bowstring 50. The primary pulley section 42 has an oval shape as illustrated in FIGS. 3 and 4 with an axle opening relatively close to the periphery to provide the eccentric mounting. The sheave of pulley 42 is in a single plane normal to the axis of the axle shaft.

Figure 2:
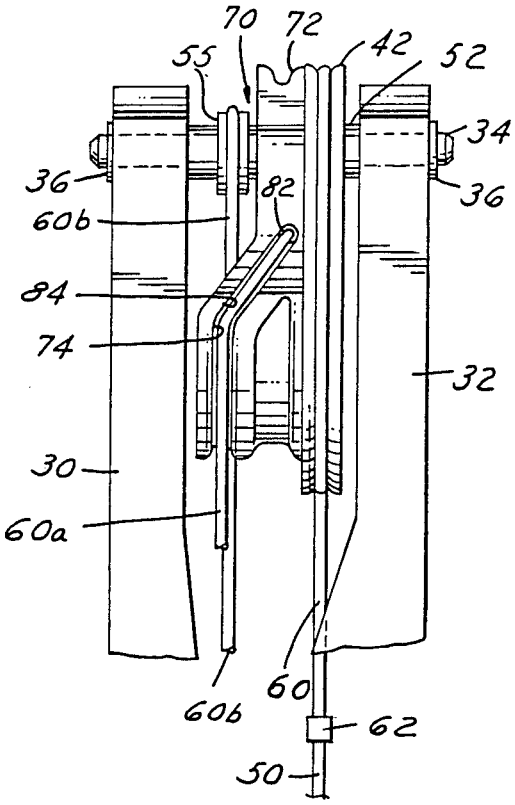
FIG. 2, a view of a pulley assembly at one end of a bow limb on line 2—2 of FIGS. 1 and 4.
Figure 5:
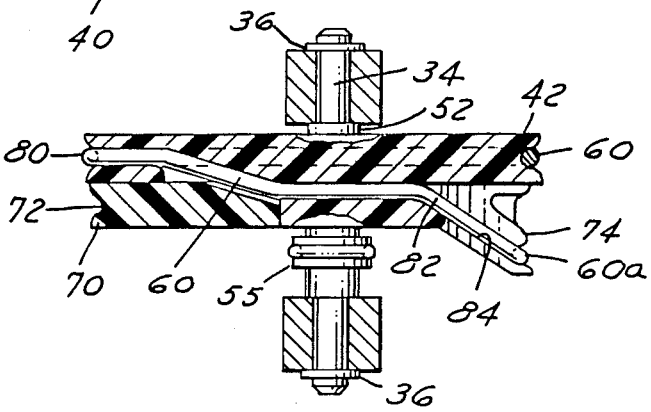
FIG. 5, a sectional view on line 5—5 of FIG. 4.

As shown in FIG. 2, a view taken on line 2—2 of FIG. 1 at the top of the bow, a short spacer 52 on axle 34 positions the primary wheel or pulley a short distance from the box limb extension 32. Adjacent the other limb extension 30 is a combination spacer and anchor sheave 55. This sheave 55 positions the anchor point of return cables as close as possible to the center of the bow limb while still accommodating the pulley assembly. A similar anchor sheave is positioned on the axle at the lower end of the bow.

One end of a flexible extension cable 60, FIGS. 1, 3 and 4, is attached to the top end of bowstring 50 at 62. This cable 60 passes around the pulley 42 to the point 80 and passes essentially diametrically through the pulley assembly to the exit point 82 where it rides in pulley groove 74 and stretches down in a run 60*a* to the bottom end of the bow to the anchor sheave 54 similar to anchor sheave 55 at the top of the bow.

At the bottom of the bow, as viewed in FIG. 1, the bowstring 50 is attached at 62 to a cable extension 61 which in turn encircles the pulley and exits to become cable stretch 60*b* leading to the anchor sheave 55 at the top of the bow as illustrated in FIG. 2.

A secondary pulley or transition wheel 70 is rigidly secured to the base cam 42. This secondary wheel, which may be formed of two parts as will be later described, is also eccentrically mounted as is the base cam. The secondary wheel 70 has a cable pulley groove 72 in a segmented sheave which parallels that of pulley 42 for about 120° of the periphery and then departs laterally at about a 30° angle to a second segmental sheave groove 74 spaced laterally significantly from the groove 72 as shown in FIG. 2.

As illustrated in FIG. 2, the cable extension 60*a* in groove 74 is essentially in the same lateral position as the anchored portion 60*b* relative to the limb extensions 30 and 32. It will be appreciated, that in FIG. 2, the pulleys are being viewed on line 2—2 of FIGS. 1 and 4 looking at the distal end of limb 26 from the front side opposite the archer.

With reference to FIGS. 2, 3 and 4, it will be seen that the cable extension 60 departing from the bowstring 50 at 62 encircles almost the entire periphery of the cam pulley 42 and then bends sharply in at a corner 80 to pass essentially diametrically through an internal cross-passage in the pulleys to an outlet bend 82 on the pulley sheave 70 where it becomes return run 60*a* and bends sharply to the left (FIG. 2) in an angled sheave groove 84 to the sheave groove 74 which is parallel to the sheave grooves of the base cam 42. This sheave groove 74 has a run portion parallel to that of the base cam 42 for about 60° and then jogs back in a length 76 (FIG. 6) of about 60° to sheave groove 72, FIG. 2, which again is parallel to the base cam 42. A similar action will take place from cable extension 61 at the bottom of the bow.

It will be appreciated that instead of utilizing the cross passage in the pulley, the cables 60 and 61 leaving the drawstring 50 could be terminated and anchored at the point 80. The anchor cable could then be started at the point 82 where it becomes return run 60*a*. The ends of the cable could be captured by a set screw in this arrangement.

The bowstring 50 and cable extensions 60 and 61 with return runs 60*a* and 60*b* are shown in the figures in an at-rest position. The bowstring is in line with the arrow rest clearance 90 viewed from the archer position and the return runs are to the right of the bowstring as viewed by the archer essentially in line with the anchor sheaves 54 and 55. When the bow is partially drawn, the cable extensions 60 and 61 are still in the spaced run 74 and the bowstring and cables remain in the same relative position as initially. The eccentric pulleys are still in the tension increasing position and not yet over center. One reason to offset cables 60*a* and 60*b* to the degree shown in FIG. 2 on portion 74 of pulley sheave 70 is to offset the torque created by bowstring 50 at the initial and first phase of the draw. This is highly significant in a high energy bow. This type of bow has a fast increase in cable tension and moves over to the lower bowstring pull sooner than the average compound bow. By the same token, the fast increase puts greater initial tension on the bow limbs.

When the bow is fully drawn and the eccentric pulleys are over center, the force to hold the bowstring in the fully drawn position decreases. At the same time, the cable extensions 60 and 61 move laterally in the angled run 76 (See FIG. 6) to reach the run 72 which is essentially centered between the anchor sheave 55 (FIG. 2) and the bowstring sheave 42. Thus, all of the tension on the bowstring and cables is central of the bow limb and the tension remains balanced to eliminate torque. A similar transition occurs at the lower pulley assembly.

The cables in the fully drawn position, when viewed from the archer's eye, will be clustered centrally of the bow in line with the arrow clearance and gap above the arrow rest 90. Upon release of the nocked arrow, the strings will return suddenly to their initial position providing arrow and fletching clearance as the arrow is released.

Thus, it will be seen that as the bow is initially drawn with the nocked arrow, the high tension at the bow sheave 42 is essentially balanced by the anchor cables in the spaced section 74 of the secondary cable as shown in FIG. 2. As the bowstring cable extensions 60, 61 reach the greatest tension, the forces on the bow limbs are centralized and the limbs remain free of torque. When the draw goes over center on the pulley sheaves, the bowstring cables decrease in tension and the anchor cables 60*a* and 60*b* move to the center into groove 72 of the secondary pulley as they continue to increase in tension so that, as shown in FIG. 2, the groove 72 is directly between the anchor sheave 55 and the bowstring sheave 42, thus again providing a balanced force on the bow limb.

In FIG. 7, there is illustrated an elevation of the primary bowstring pulley 42 and a segmental portion 43 of the transition pulley which may be molded directly with the main pulley or applied separately with suitable flush screws. An axle hole 104 is provided for the axle pin 34. A threaded hole 106 is provided for a set screw 108 to lock a cable in the cross passage 110 of the pulley assembly. Two holes 112 and 114 are provided to receive retainer screws 116 and 118 (FIG. 4) which thread into flush nuts 120 and 122 (FIG. 3). These screws hold an arcuate section 121 shown in elevation in FIG. 9 and in section in FIG. 10 on the main pulley section. This section 121 has holes 123 and 124 which receive the screws 116 and 118.

Thus, it will be seen that main pulley or wheel cam 72 and the transition pulley are secured together as one solid part which rotates on the axle 34. The utilization of two parts makes it easier to form the chordal cross passage 110.

In order to insure proper tracking of the cable 60*a* and 60*b*, the sheave of the pulley is raised from the normal sheave as illustrated at 100 in FIG. 6 and at 100 in FIG. 9. Thus, when the cable under tension is being shifted by the cable grooves from its laterally outward position in groove 74 to the close coupled position in groove 72, it will be forced laterally over and will not jump the track, so to speak, in the transition movement.

As previously described, the segmental shape of the secondary pulleys 43 and the supplemental part 120

(FIG. 9) and the outward lateral sweep toward the circumference of the portion forming the grooves 74 and 84, as best shown in FIGS. 2, 8 and 9, provides a packet for the location of the anchor sheaves 54 and 55 at the respective ends toward the center of the axle so that the sheaves can position adjacent the secondary pulley portion 72. Thus, as viewed in FIG. 2, the anchor sheave 55 is behind the grooved portion 74, 84 and actually closer to center than the groove 74 at the initial draw phase of the bow.

The grooves of the pulley assembly may be characterized as having a primary first bowstring pulley. Then there is a secondary cross-cable pulley having a first segmental groove 74 parallel to the bowstring groove spaced to the opposite side of the distal limb. A second segmental sheave groove 72 is parallel to the bowstring pulley and spaced laterally between the bowstring groove and said first segmental groove. A third segmental groove 76 is angled between the grooves 74 and 72 to serve as a transition groove during the power pull. Specifically, the pulley assembly is essentially flat on the side of the primary bowstring sheave. The other side of the assembly is also essentially flat in the chordal area including the axle hole and bordered by the second segmental groove 72. This flat area extends over about half of the area of this side of the pulley assembly. Beyond this flat area, the pulley assembly flares outwardly away from the plane of the bowstring pulley an in this flared portion are peripherally formed the first and third segmental grooves. There is then axial and radial clearance for the anchor point 55 such that there is a no interference when the pulley assembly is rotated in the draw action.

What is claimed is:

1. In a compound archery bow having a handle member, a pair of bow limbs projecting from opposite ends of the handle member and terminating in a birfurcate distal end, an eccentrically mounted pulley assembly rotatable on an axle shaft at the edistal end of each bow limb, a bowstring associated at each end with said pulley assembly, and cross-cables each anchored at one distal end of a bow limb and associated with the pulley assembly at the other end, that improvement in the pulley assembly which comprises:

(a) a primary first bowstring pulley sheave on said axle shaft adjacent one side of a birfurcate distal limb end having a bowstring pulley groove in a plane normal to said axle, (b) a secondary cross-cable pulley having a first segmental sheave groove substantially parallel to said bowstring pulley groove and adjacent the other side of said birfurcate distal limb end, and having a second segmental sheave groove parallel to said bowstring pulley groove and spaced laterally between said sheave of said bowstring pulley and said first segmental sheave groove, and having a third segmental transition sheave groove circumferentially disposed between said first and second segmental sheave grooves and angled transversely to connect said first and second sheave grooves, (c) said pulley assembly having a relatively flat face on the side in which said primary bowstring pulley sheave is formed, and having the opposite side relatively flat in a first chordal portion in which said second segmental sheave groove is peripherally formed in the area of said axle, said opposite side having a second portion extending laterally and radially outward away from said flat first chordal portion and said primary bowstring pulley, in which said second portion said first, and third segmental grooves are peripherally formed, (d) an anchor point for a cross-cable positioned laterally toward the center point of said axle between said bifurcate sides of a bow end and in a plane normal to said axle shaft and substantially in a plane of said first segmental sheave groove, said first segmental sheave groove in said secondary cross-cable pulley being spaced radially outward of said anchor point to place said anchor point laterally adjacent said second segmental sheave groove and radially inside said first, and third segmental sheave grooves, (e) a bowstring between said bowstring pulley sheaves at the respective ends of the bow limbs to operate in said primary pulley, and (f) cross-cables each anchored respectively at one end at an anchor point and passing at the other end around the respective first, second, and third segmental sheave grooves of said secondary cross-cable pulley during the operation of the bow, whereby in the undrawn position of the bowstring and in the initial phase of the draw of said bow, said other ends of said cross-cables are moving in said first groove and as the draw continues to full draw, the cross-cables move in said transition groove from said first groove to said second segmental sheave groove wherein at full draw said bowstring cable, said cross-cable and said anchor point are closely adjacent each other and to the plane of said primary bowstring pulley sheave on said pulley axle between the bifurcate sides of the distal ends of said bow limbs.

2. A compound archery bow as defined in claim 1 in which the sheave forming the third segmental transition groove has a raised wall on the side opposite the primary bowstring pulley sheave to cam a cross-cable laterally toward said bowstring pulley as it moves from said first segmental sheave groove to said second segmental sheave groove.

* * * * *